United States Patent [19]

Vinner et al.

[11] 4,129,083

[45] Dec. 12, 1978

[54] JOINING OF A MULTIPLE-LAYER FABRIC BY INVISIBLE STITCHING

[76] Inventors: Robert E. Vinner; Max Parisot; Jacques Parisot, all of 53-55, rue d'Avron, Paris 20, France

[21] Appl. No.: 810,059

[22] Filed: Jun. 27, 1977

[30] Foreign Application Priority Data

Jul. 22, 1976 [FR] France ..... 76 22381

[51] Int. Cl.[2] ..... D05B 1/24

[52] U.S. Cl. ..... 112/178

[58] Field of Search ..... 112/176, 178, 177, 140, 112/163, 165, 166, 197-199, 267, 420, 438, 440; 66/85 A

[56] References Cited

U.S. PATENT DOCUMENTS

| | | | |
|---|---|---|---|
| 1,548,897 | 8/1925 | Mueller | 112/178 |
| 2,074,663 | 3/1937 | Mitchell | 112/420 |
| 3,461,827 | 8/1969 | Strobel et al. | 112/178 |

*Primary Examiner*—Peter Nerbun

*Attorney, Agent, or Firm*—Andrus, Sceales, Starke & Sawall

[57] ABSTRACT

The invention relates to the joining of a multiple-layer fabric by invisible stitching, whereby two folds are made in two strips of fabric, which folds are brought close to each other so that the ridges thereof are adjacent and parallel, a series of stitches is made between the two ridges of the two folds, in the thickness of the fabric, and these operations are repeated after having displaced the two strips of fabric and thus the ridges of the two folds. The invention is more particularly applied to woollen fabrics.

8 Claims, 10 Drawing Figures

FIG. 4A
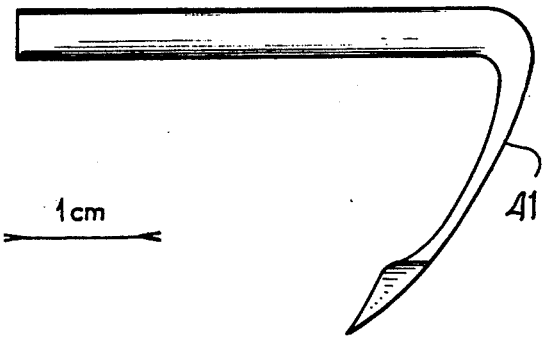
FIG. 4B
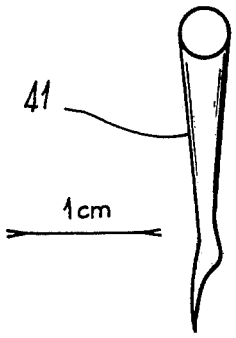
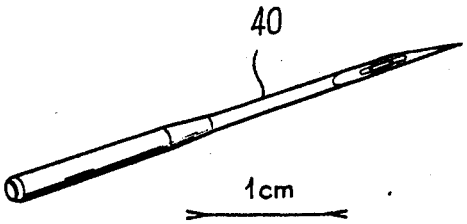
FIG. 3

JOINING OF A MULTIPLE-LAYER FABRIC BY INVISIBLE STITCHING

BACKGROUND OF THE INVENTION

It is often desirable to obtain a multiple-layer fabric, i.e. a fabric constituted by the joining of a plurality of layers of fabric, particularly for wollen fabrics such as those used for making suits, coats and like garments.

Up to the present time, multiple-layer fabrics have been made by weaving together two layers of different constitution. For example, they may have a common weft thread. As this technique is employed at manufacture, it suffers from an obvious lack of suppleness.

Another technique, which is easier to adapt, consists in joining a plurality of layers of fabric by heat-sealing. In this second case, the bond between the different layers of fabric is generally more rigid that the fabrics themselves. This results in the heat-sealed multiple-layer fabric being less supple and having a feel which is disagreeable to some. This limits the possibilities of application of heat-sealing, particularly for woollen fabrics.

It is an object of the present invention to provide another technique of joining a multiple-layer fabric, by sewing, or making an invisible stitch with threads or yarn to join or form a multiple-layer fabric.

SUMMARY OF THE INVENTION

The invention therefore relates to a method of joining together a multiple-layer fabric, comprising the combination of the following steps of:

(a) forming in two strips of fabric two respective folds which are brought close to each other so that the tops thereof are adjacent and parallel (b) making a series of stitches between the tops of the two folds, in the thickness of the fabric, and (c) repeating these operations after having displaced the two strips of fabric and thus the tops of the two folds.

More precisely, operation (a) consists in passing the two strips over two respective acute-angled guides offering parallel, adjacent rectilinear ridges and operation (c) consists in pulling the two strips of fabric between the two guides, jointly and by one step, after they have been sewn on the ridges.

The stitches are preferably made simultaneously along the width of the strips, i.e. along the ridge and the sewing yarns follow the length of the strips. The stitches are advantageously of the chain-stitch type.

The above method enables a two-layer fabric to be obtained. The invention is not limited to the case of two layers and one or more intermediate strips of fabric may be inserted; the or each intermediate strip is placed between the two folds, and the stitches are made in the thickness of the top of one of the folds, then through the or each intermediate strip and finally in the thickness of the top of the other fold. As before, the operations are repeated after having displaced, each time by the same distance, the or each intermediate strip together with the two outer strips, simultaneously.

The invention also relates to a multiple-layer fabric as obtained according to the method defined herein.

The invention further relates to a machine for joining together a plurality of layers of fabric, by invisible stitching, comprising:

a sewing station where two acute-angled guides are disposed side by side to offer two parallel, rectilinear, adjacent ridges, two fabric dispensing devices, supplying two strips of fabric on either side of the two guides, applying the strips on the outer faces of the guides, respectively, a step-by-step drive device adapted to pull the two strips of fabric jointly between the two guides, a needle-holder carriage, movable so that the needles enter in the thickness of the strips of fabric when said latter rest on the ridges of said guides, and provided with a device for supplying the needles with yarn, a hook-holder bar mounted with respect to the needle-holder carriage and pivotal, in association with the movement of the carriage, in order to allow a chain stitch, and a control alternately allowing the movement of the needle-holder carriage and the hook-holder bar to make a series of stitches, and the movement, by one step, of the drive device for advancing the fabric.

BRIEF DESCRIPTION OF THE DRAWINGS

The invention will be more readily understood on reading the following description with reference to the accompanying drawings, in which:

FIG. 3 illustrates the type of sewing needle used in the preferred embodiment of the invention.

FIGS. 4A and 4B illustrate the type of hook used in the preferred embodiment of the invention.

BRIEF DESCRIPTION OF THE PREFERRED EMBODIMENT

Figure 1:
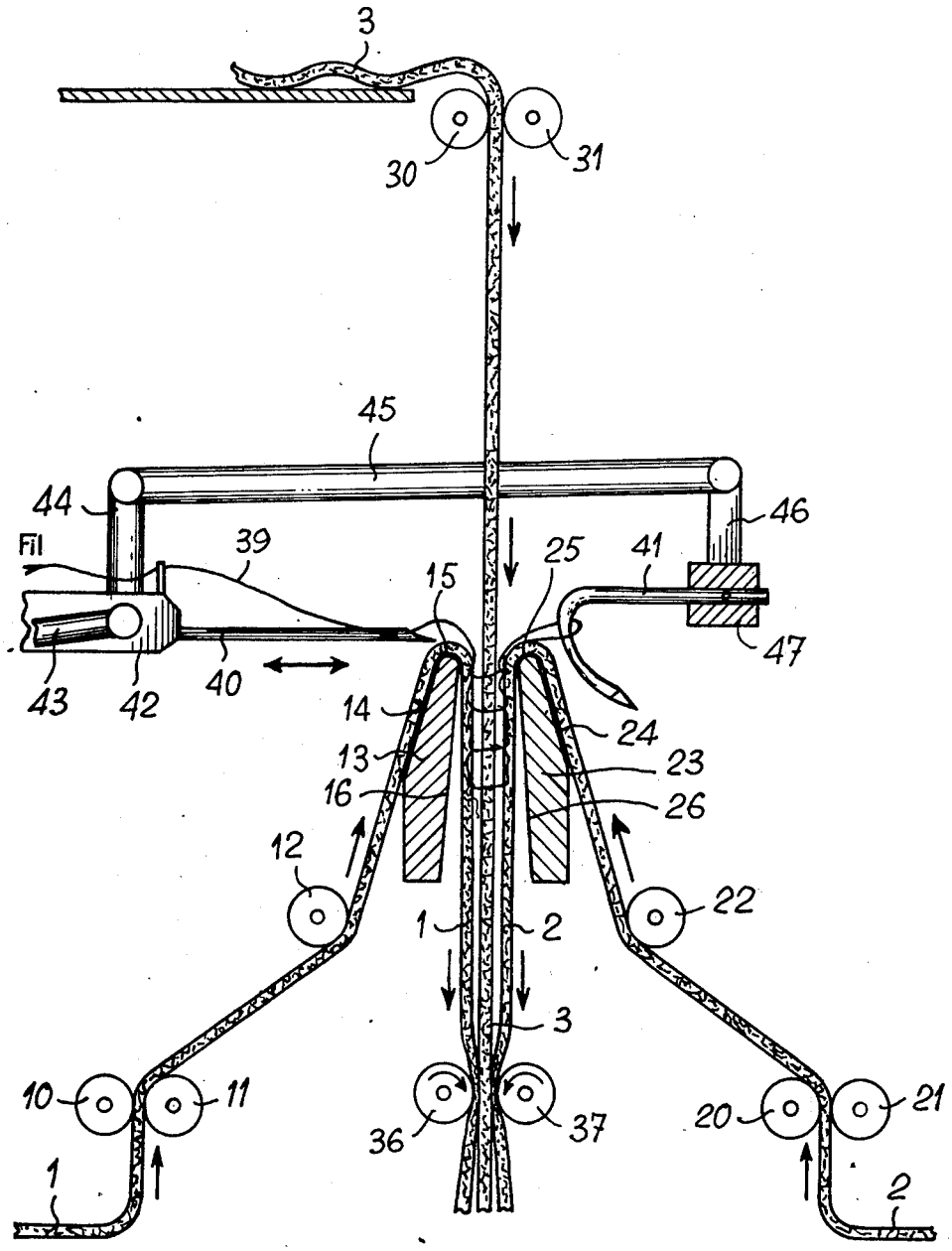
FIG. 1 is a diagram generally illustrating the execution of the method according to the invention.

Referring now to the drawings, FIG. 1 illustrates the execution of the method according to the invention. A first strip of fabric 1 arrives from the bottom left of FIG. 1. It firstly passes between two feed rollers 10 and 11 which are pressed against each other. It then curves around a tensioner roller 12 before reaching a first guide 13. The fabric 1 reaches the guide 13 at its inclined outer face 14. It folds over the ridge 15, and then passes downwardly on the other side of the guide 13, on its inner face 16 which is generally flat and slightly outwardly oblique with respect to the vertical.

On the right hand side of FIG. 1, and in the same manner, a second strip 2 of fabric firstly passes between two feed rollers 20 and 21. It then curves over a tensioner roller 22 and thereafter meets a second guide 23. There again, the strip of fabric 2 follows the inclined outer face 24 of the guide 23; it then folds over the ridge 25 and thereafter passes downwardly on the other side of the guide 23 on its inner flat face 26 which is oblique with respect to the vertical.

In this way, in each guide 13 or 23, the outer face 14 or 24 makes an acute angle with the inner face 16 or 26. On these acute angles are formed two folds in the two strips of fabric 1 and 2.

The tops of the folds are located at the ridges 15 and 25 of the two guides 13 and 23. It is clear that the ridges of the strips of fabric are rectilinear, parallel and adjacent, in the same way as the ridges 15 and 25 of the guides. (In FIG. 1, the distance between the two guides has been enlarged to clarify the illustration).

A third strip of fabric, 3 advantageously, but not necessarily, passes between two feed rollers 30 and 31, before passing in the gap between the two guides 13 and 23, between the strips of fabric 1 and 2. A plurality of intermediate strips of fabric may obviously be inserted in this manner.

Finally, the assembly of strips of fabric 1, 2 and 3 emerges downwardly from between the guides 13 and 23 and is taken between two drive rollers 36 and 37.

According to the second stage of the method, a series of stitches is made between the ridges of the two folds of the strips 1 and 2, i.e. slightly above the level of the ridges 15 25 of the two guides. The stitches are made in the thickness of the fabrics 1 and 2 and through the one or intermediate strips of fabric 3, as the case may be.

A series of needles make a series of stitches along the parallel ridges of the folds of fabric. However, FIG. 1, being a view in section, shows only one needle.

These stitches are preferably of the chain-stitch type, and a plurality of needles such as 40, cooperate with a series of hooks such as 41.

The needle 40 is of the type with a laterally offset tip. Such needles are conventionally named "ser" by the makers, or DA according to international standards.

The needle is shown in detail in FIG. 3, which is incorporated in the present specification to define the type of needle which may be used according to the present invention, as its shape is otherwise indefinable.

The hook 41 is adapted to cooperate with a needle such as has just been defined. This hook is of the looping hook type for a chain-stitch sewing machine, shown in FIGS. 4A and 4B. These Figures are incorporated in the present specification, to define the shape of the hook.

A needle-holder carriage 42, moved by a rod 43, connected to a cam (not shown in FIG. 1) causes the needles 40 to move in reciprocating motion in a plane located slightly above the plane of the ridges 15 and 25 of guides 13 and 23. This plane must in fact pass in the thickness of the two folds formed in the two strips of fabric 1 and 2.

Via a support member 44 and a rod 45, the needle-holder carriage 42 drives a crank pin 46 in a synchronous movement, which itself acts on a shaft 47, of square section, carrying the hooks 41.

In this way, whilst the needles 40 are moving in a reciprocating motion, the hooks 41 oscillate from a substantially horizontal position to about 45° with respect to the horizontal.

Each reciprocating motion of the needles and oscillatory movement of the hooks produces a series of chain stitches between the two ridges of the two folds, in the thickness of the two strips of fabric and, as the case may be, through the one or more intermediate strips located therebetween.

After each series of stitches, the drive rollers 36 and 37 advance synchronously by one step, pulling the portion of multiple-layer fabric which has just been sewn, downwardly, and the process recommences.

In this way, each needle produces a series of chain-stiches with a yarn which follows a vertical path, or more particularly the length of the strips of fabric.

The transverse spacing of the stitches along the ridges is between 3 and 30 mm, and preferably between 5 and 20 mm; it will advantageously be chosen to be 7 mm for fabrics of classical type.

Similarly, the advance step of the strips of fabric is between 3 and 30 mm, and preferably between 5 and 20 mm. It will advantageously be 7 mm for classical fabrics. Of course, the advance step is not necessarily the same as the spacing of the stitches along the ridges.

With reference now to FIGS. 2A to 2E, the application of the chain stitch to the sewing stitches according to the invention will now be described. These Figures are much simplified to render the drawing clear. In particular, guides 13 and 23 are not shown, nor any of the drive rollers. Nor is the central strip of intermediate fabric shown, nor the mechanisms driving the needles and hooks. Finally, the spacing of the folds of fabric is exaggerated and the dimensions of the needle and the hook are not respected.

Figure 2A:
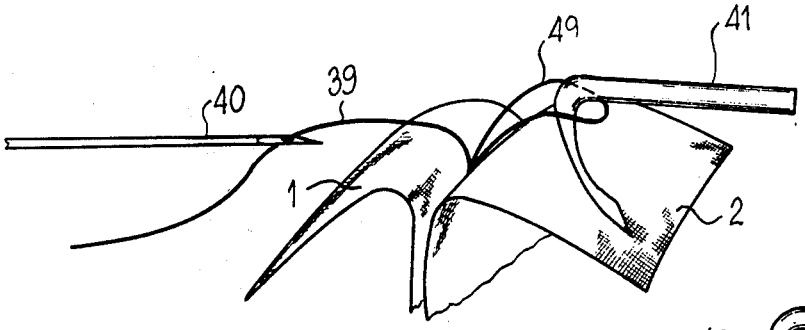
FIGS. 2A to 2E show, very schematically, the execution of the chain stitch used in a preferred embodiment of the invention.

In FIG. 2A, the yarn 39 passes through the eye of the needle 40, coming between the two strips of fabric 1 and 2 from the previous stitch. Similarly, from this previous stitch comes a loop 49 in which the hook 41 is engaged. FIG. 2A therefore shows the initial position of a chain stitch.

Figure 2B:
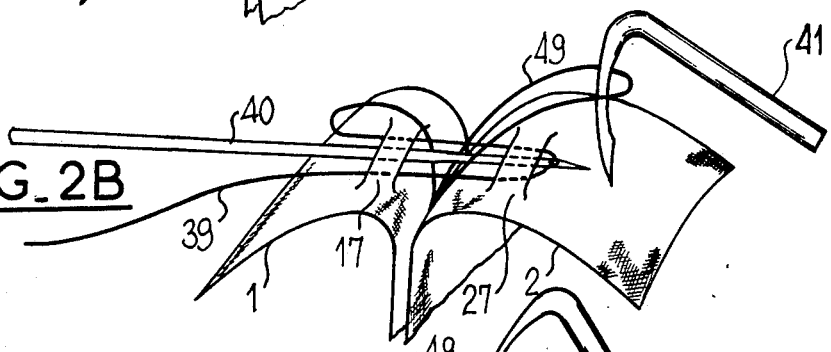

FIG. 2B shows that the needle has passed beneath one or more threads 17 of the fabric 1, causing yarn 39 to pass therethrough. It also passes beneath one or more threads 27 of fabric 2, after having passed over the gap between fabrics 1 and 2 and in the loop 49, which is still held by hook 41.

Figure 2C:
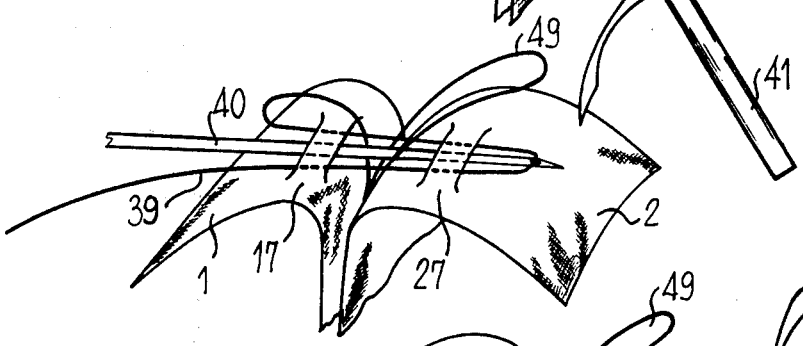

In FIG. 2C, at the end of its horizontal stroke towards the right, the needle 40 has passed through the fabric 2, and hook 41 has released the loop 49.

Figure 2D:
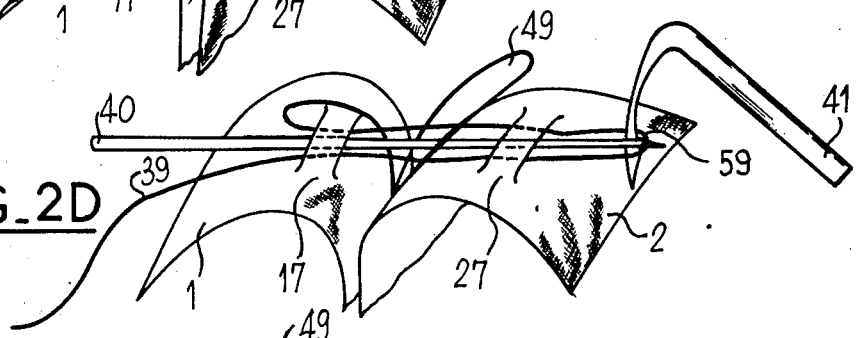

In FIG. 2D, the needle 40 is about to begin its withdrawal movement towards the left of the Figure, leaving a new loop 59 on which hook 41 engages.

Figure 2E:
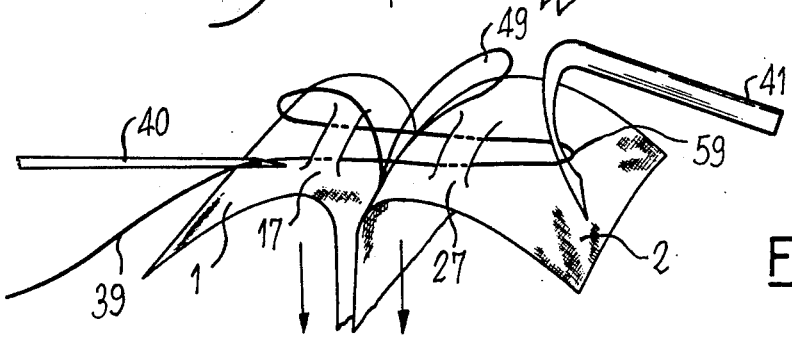

Finally, in FIG. 2E, the needle 40 has returned substantially to its initial position. Former loop 49 remains between the two strips of fabric 1 and 2. It surrounds the new loop formed by the yarn 39 at its center. This new loop passes in 17 in the thickness of fabric 1 and in 27 in the thickness of fabric 2. Hook 41 now engages in the end 59 of this new loop.

At this moment, the two strips of fabric 1 and 2 will be pulled downwardly, as indicated by the arrows in FIG. 2E. The zones 17 and 27 which have been penetrated by the needles will therefore also pass downwardly and face to face, this also having for its effect to pull on the loop 49.

After this displacement by one step, the position will be the same as in FIG. 2A, and a new series of stitches may be made on the ridge of the folds formed in the two strips of fabric 1 and 2 by the guides.

By way of example, this method may produce a strip of multiple-layer fabric of about 400 mm width and 800 mm length. Fifty eight needles cooperate with 58 hooks to make 58 stitches spaced apart by about 7 mm. The stroke of the needles is about 30 mm and the pivoting angle of the hooks about 45°.

The yarn may be of any type: wool, cotton, nylon, invisible yarn. The invention is mainly applied to woollen fabric with the interposition of baize, but it may be used with other fabrics.

It should also be noted that, for certain applications, no stitch will be made near the edge, this being ensured by eliminating the end needles. In other cases, other needles may likewise be eliminated, for example every other one, in order further to increase the suppleness.

Moveover, the embodiment which has been described makes use of straight needles, but curved needles with the same features may also be used. In this case, the needles are submitted to a movement following their curvature so as to penetrate the thickness of the two end folds of fabric.

The guides 13 and 23 have been described and shown as being solid, and generally trapezoidal in form. Although this geometry is clearly preferable, particularly for cooperating with the tensioner rollers 12 and 22, it is also possible that the ridges 15 and 25 be defined by the rectilinear edges of two steel plates possibly provided with suitable stiffeners. The diagram of FIG. 1, which is not to scale, may lead one to believe that the ridges 15 and 25 are not sharp. In fact, these ridges are relatively pointed in order to form folds in the fabric whose top extends from the ridge. Of course, these ridges 15 and 25 of the guides 13 and 23 are suitably treated to avoid damaging the fabrics.

The feed rollers 10, 11, 20, 21, 30, 31, tensioner rollers 12, 22 and drive rollers 36, 37 are made of steel sheathed with rubber. As a variant, rollers may be used which are made of plastics material having equivalent characteristics.

Figure 5:
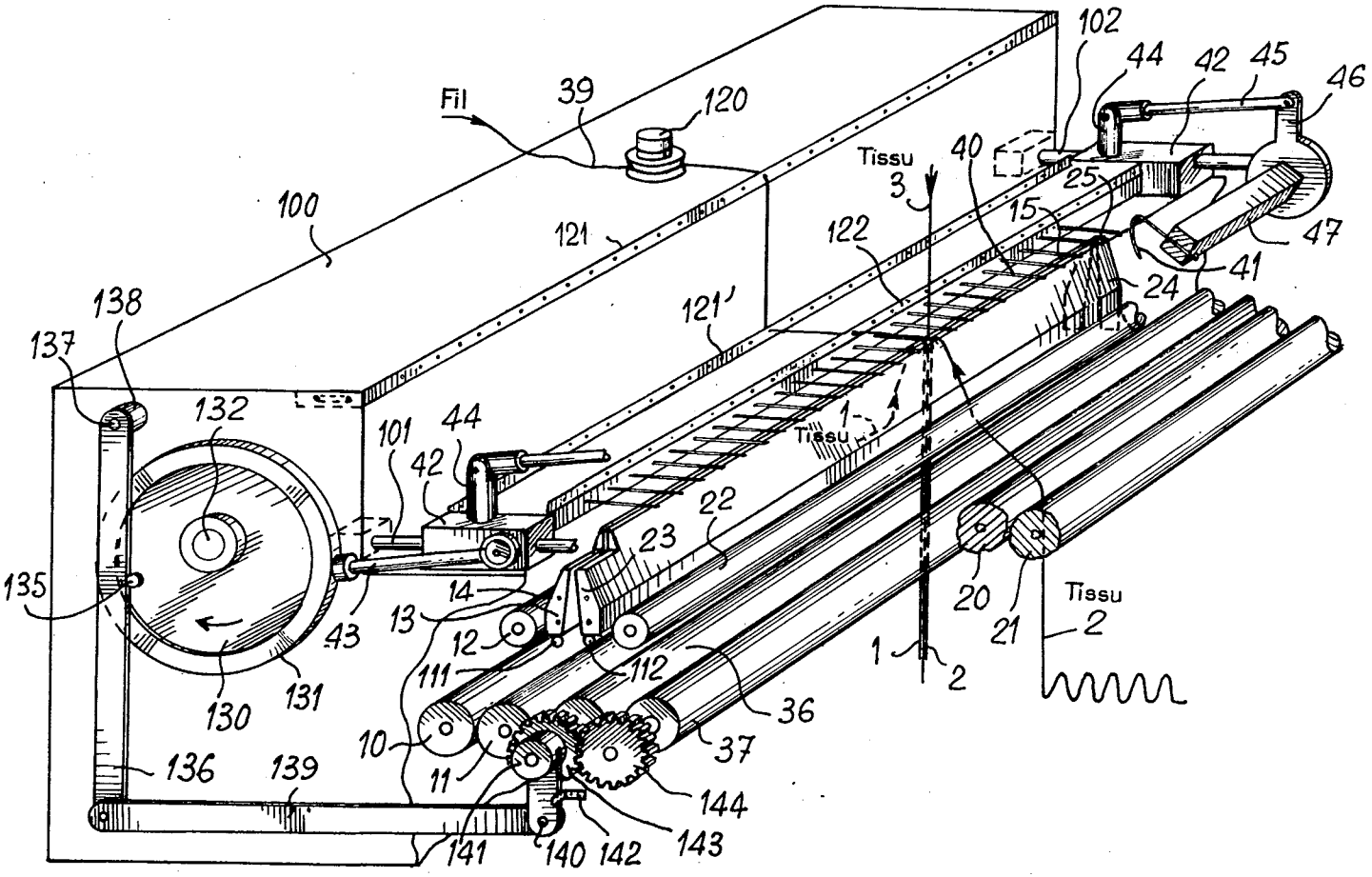
FIG. 5 schematically illustrates a machine for making multiple-layer fabric.

FIG. 5 shows a machine for carrying out the method according to the invention. The elements which were shown in FIG. 1 have retained the same references.

The machine shown in FIG. 5 generally comprises a frame forming casing 100. In the right-hand part of this Figure, this casing has been shown broken away in order better to illustrate the mechanism. In this same part of the Figure, the rear part of several elements has also been truncated to simplify the drawing. Moreover, the rollers 20 and 21 as well as the hook-holder bar 47 have been truncated at the front.

The machine firstly comprises a sewing station, where two acute-angled guides 13 and 23 are disposed side by side in order to offer two adjacent, rectilinear and parallel ridges 15 and 25. The guides 13 and 23 are the same as in FIG. 1.

The machine further comprises (at least) two fabric dispensing devices which supply the strips of fabric 1 and 2 on either side of the two guides 13 and 23. The first dispensing device comprises feed rollers 10 and 11, and the tensioner roller 12. This device applies the strip of fabric 1 on the inclined outer face 14 of the guide 13. The movement of this first fabric has not been shown in detail in FIG. 5, with a view to clarity. It is identical to that of the second strip of fabric 2.

The second strip of fabric 2 is supplied by the second dispensing device which comprises feed rollers 20 and 21, and the tensioner roller 22. The fabric is thus applied on the inclined face 24 of the guide 23.

The fabrics 1 and 2 form a fold on the ridges 15 and 25 of the two guides and then pass downwardly between the two guides 13 and 23.

After they have emerged from the bottom of the guides, the joined strips of fabric are taken by a step-by-step drive device, comprising the two rollers 36 and 37.

A third fabric dispensing device may also be provided, if need be, supplying at least one intermediate strip of fabric between the other two, as indicated previously.

At the sewing station, a needle-holder carriage 42 provided with a series of needles 40 cooperates with a hook-holder bar 47 provided with a series of hooks such as 41. The position of the hook-holder bar is adjustable by means which have not been shown. (It will be recalled that it has been truncated to illustrate the rest of the device.) This bar 47 is fast with a crank pin 46, connected by a rod 45 to a support member 44 mounted on the needle-holder carriage 42. This assembly is provided at the two ends of the machine. Moreover, the rods 45 have two reciprocal screw threads at their end, to allow an adjustment of the movement of the hook-holder bar with respect to that of the needle-holder carriage, in the manner of a swivel.

The two ends of the needle-holder carriage slide on parallel guide rods 101 and 102, fast with the frame 100. There again, one of the ends of the rods has been truncated to allow other members to be shown. These rods 101 and 102 are suitably orientated for the movement of the carriage 42 to cause the needles 40 to undergo a reciprocating movement in a plane located slightly above the ridges 15 and 25 of the two guides 13 and 23, in order to penetrate the thickness of the two folds of the fabrics. As the machine may receive fabrics of different thicknesses as outer strips 1 and 2, cams 111 and 112 are provided to adjust the level of the ridges 15 and 25.

Furthermore, yarn is supplied to each needle. For simplification, only one yarn 39 has been shown, which firstly passes through a conventional tensioner device 120. It then passes into a suitable hole in a first yarn guide bar 121 fast with the frame 100 but whose position is adjustable. The yarn then passes through two other yarn-guide bars 121' and 122, which are mounted on carriage 42. The yarn-guide bar 122 is located in the immediate vicinity of the needles, whilst the bar 121' is located on the opposite edge of the carriage 42.

The cooperation of the needle-holder carriage, with this supply of yarn, and the hook-holder bar 47 is identical to what has been described hereinabove.

It is clear that the hook-holder bar will rotate upwardly through about 45° from the horizontal, when the needle-holder carriage is subjected to a translation, the stroke of which is about 30 mm. This translation is obtained by means of the rod 43 mounted at one of the ends of the carriage 42, and at the other on the peripheral ring 131 of a cam 130. There again, the rod 43 is provided at its ends with two reciprocal screw threads to form a swivel, and to adjust the stroke of the carriage.

The cam 130 is movel around its axis 132 by drive means which have not been shown.

The action of the cam on the needle-holder carriage 42, then of said latter on the hook-holder bar 47 enables a series of chain-stitches to be made in the manner which has been described hereinabove with reference to FIGS. 1 and 2A to 2E.

When the carriage 42 is in its completely retracted position (corresponding to FIG. 2E), a lug 135 mounted on the cam 130 moves, towards the left of the Figure, a bar 136 mounted to pivot about an axis 137 whose position is adjustable on a pin 138. The bar 136 pivots on a second bar 139 which controls a crank pin 140 actuating a unidirectional drive member with ratchet 141. The crank pin 140 normally rests on a stop 142. The angular movement of the crank pin 140 depends, therefore, only on the adjustable position of the stop 142, and on the likewise adjustable position of the axis 137, taking into account the ratio of the lever arms between the crank pin 140 and the arm 136. In this way, a rotation is obtained by an adjustable step of the drive roller 36, which transmits this movement to the drive roller 37 cooperating therewith, via the set of gear wheels 143 and 144.

In this way, a control is effected which alternately allows the movement of the needle-holder carriage and of the hook-holder bar to make a series of stitches, and the movement by one step of the drive device for advancing the fabric.

In the machine which has just been described, the two pairs of feed rollers (at least) and the pair of drive rollers are each associated with respective elastic means which are preferably adjustable (not shown). In each pair, these elastic means urge the two rollers against each other. Each of the two tensioner rollers 12 and 22 is associated with elastic means urging it to stretch the fabric on the inclined face of the mould with which it cooperates. Finally, all these rollers are of course braked rollers, in order that the fabric always be stretched.

The machine which has just been described functions at a rate of about 120 to 150 series of stitches per minute. If the advance step of the fabric is 7 mm, this means that the machine may produce a piece of multiple-layer fabric, 400 mm wide and 800 mm long, in about 1 minute. Of course, it may also produce the fabric continuously.

It will be noted that the above rate corresponds to a speed of rotation of 120 to 150 rpm. Present-day sewing machines function up to 4000 rpm. It is clear, continuously, the speed of the machine according to the invention may easily be increased to 1000 rpm, this corresponding to a rate which is about six times greater than the values given above.

What is claimed is:

1. In a machine for joining together a plurality of layers of fabric by invisible stitching, of the type comprising:

a sewing station where two acute-angled guides having ridges are disposed side by side to offer two adjacent, rectilinear and parallel ridges, two fabric dispensing devices, supplying two strips of fabric on either side of the two guides, a step-by-step drive device adapted to pull the two strips of fabric jointly over the ridges of the guides and thence between the two guides, the combination of:

a needle-holder carriage, holding a plurality of needles movable so that the needles penetrate the thickness of the strips of fabric when said latter rest on said ridges of the guides, as well as a device for supplying the needles with yarn, a hook-holder bar holding a plurality of hooks and homologous with the needle-holder carriage, pivoting with the movement of the carriage in order to allow a chain-stitch, and a control allowing alternately the movement of the needle-holder carriage and of the hook-holder bar to make a series of stitches, and the movement of the drive device for advancing the fabric.

2. The machine of claim 1, and the hooks being of the loop holding type formed by a reverse bend and pivotable about an axis parallel to the ridges on the guides, and the needles being disposed opposite the hooks and having laterally offset tips and movable in a reciprocating motion through the fabric by the needle holder carriage.

3. The machine of claim 1, and feed rollers disposed to feed at least one strip of a third fabric between the two strips of fabric passing over the ridges of the guides.

4. The machine as recited in claim 1, wherein the needles are straight, of the type with a laterally offset tip, and the movement of the needle-holder carriage is a translation in a plane located slightly above the two parallel ridges.

5. In a method of making a multiple-layer fabric by invisible stitching, comprising the steps of (a) passing first and second strips of fabric over two respective acute-angled guides offering rectilinear, parallel and adjacent ridges, to form two folds of fabric of which the tops are adjacent and parallel, (b) actuating a plurality of needles individually cooperating with yarn, transversely to said ridges, for passing these needles within the thickness of the fabrics to join the tops of the two folds of fabric by a series of stitches distributed therealong;

(c) repeating step b) after having pulled a length of the joined strips between the two guides, in a direction away from the ridges of the guides, the improvement of step (b) including pivoting a plurality of hooks in synchronism with the actuation of the needles, so that each hook initially retains a loop of yarn from a prior stitch, passing the needles through the first fabric and the prior formed loop then located in the gap between the fabrics before passing through the second fabric, and each hook finally retaining a respective loop of yarn from the new stitch after the needles have passed through both strips of fabrics for disposal between the fabrics in repeating the operation.

6. The method as recited in claim 5, wherein the needles are straight needles of the type with a laterally offset tip, which are commonly movable in translation in the plane of the tops of the folds, and the hooks are commonly pivotable about an axis parallel to the ridges.

7. The method as recited in claim 5, wherein at least one intermediate strip of fabric is inserted between the two folds, the stitches are made in the thickness of the top of one of the folds then through said intermediate strip, and finally in the thickness of the top of the other fold, and step d) includes pulling the intermediate strip together with the two outer strips.

8. The method as recited in claim 5, wherein the transverse spacing of the stitches is between 3 and 30 mm, preferably between 5 and 20 mm, and that the length of pulling the joined strips of fabric is between 3 and 30 mm and preferably between 5 and 20 mm.

* * * * *

UNITED STATES PATENT AND TRADEMARK OFFICE

CERTIFICATE OF CORRECTION

PATENT NO. : 4,129,083

DATED : December 12, 1978

INVENTOR(S) : ROBERT E. VINNER, ET AL

It is certified that error appears in the above-identified patent and that said Letters Patent are hereby corrected as shown below:

Column 8, insert the following claim:

---9. A multilayer fabric obtained by the method as claimed in claim 5.---

Signed and Sealed this

*Thirty-first* Day of *July 1979*

[SEAL]

*Attest:*

*Attesting Officer*

LUTRELLE F. PARKER

*Acting Commissioner of Patents and Trademarks*